US011047165B1

(12) United States Patent
Monts De Oca

(10) Patent No.: US 11,047,165 B1
(45) Date of Patent: Jun. 29, 2021

(54) DURABLE ENTRYWAY THRESHOLD

(71) Applicant: Jerry L. Monts De Oca, Tampa, FL (US)

(72) Inventor: Jerry L. Monts De Oca, Tampa, FL (US)

(73) Assignee: Jerry L. Monts De Oca, Tampa, FL (US)

( * ) Notice: Subject to any disclaimer, the term of this patent is extended or adjusted under 35 U.S.C. 154(b) by 0 days.

(21) Appl. No.: 16/825,375

(22) Filed: Mar. 20, 2020

Related U.S. Application Data

(60) Provisional application No. 62/908,771, filed on Oct. 1, 2019, provisional application No. 62/824,025, filed on Mar. 26, 2019.

(51) Int. Cl.

| | |
|---|---|
| ***E06B 1/70*** | (2006.01) |
| ***E06B 7/14*** | (2006.01) |
| *E06B 7/23* | (2006.01) |
| *E06B 1/62* | (2006.01) |
| *E06B 3/96* | (2006.01) |

(52) U.S. Cl.
CPC ..... *E06B 1/70* (2013.01); *E06B 7/14* (2013.01); *E05Y 2900/132* (2013.01); *E06B 3/9632* (2013.01); *E06B 7/2316* (2013.01); *E06B 2001/622* (2013.01); *E06B 2001/707* (2013.01)

(58) Field of Classification Search
CPC .... E06B 1/70; E06B 7/2316; E06B 2001/707; E06B 2001/70
See application file for complete search history.

(56) References Cited

U.S. PATENT DOCUMENTS

| | | | | | |
|---|---|---|---|---|---|
| 3,690,037 | A * | 9/1972 | Kempel | E06B 1/70 | 49/380 |
| 5,012,614 | A * | 5/1991 | Shea | E06B 1/70 | 49/468 |
| 5,136,814 | A * | 8/1992 | Headrick | E06B 1/70 | 49/468 |
| 5,179,804 | A * | 1/1993 | Young | E06B 1/70 | 49/468 |
| 5,230,181 | A * | 7/1993 | Geoffrey | E06B 1/70 | 49/469 |
| 5,524,391 | A * | 6/1996 | Joffe | E06B 1/524 | 49/467 |
| 5,611,173 | A | 3/1997 | Headrick et al. | | |

(Continued)

*Primary Examiner* — Marcus Menezes
(74) *Attorney, Agent, or Firm* — Shumaker Loop & Kendrick, LLP; Jeffrey B. Fabian

(57) ABSTRACT

Disclosed is a threshold assembly that is durable and resistant to damage from mechanical stress and ultraviolet light exposure, thermally insulating, aesthetically pleasing, and adjustable to accommodate varying door heights and entryway dimensions and that can also be manufactured in a cost effective manner. The threshold includes base portion having a front face that accommodates an extender, a top surface, a channel, a nose wall, and an optional sizing notch that allows the threshold to be cut to varying entryway widths. The threshold further includes a deck cover secured about the base portion and a cap disposed within the base channel. An adjustment screw is disposed within the cap and used to vary the height of the threshold assembly to create an appropriate fit to an associated door. The deck cover or other components can be made of a durable coextruded material with impact or other modifiers.

24 Claims, 9 Drawing Sheets

(56) References Cited

U.S. PATENT DOCUMENTS 6,345,477 B1 * 2/2002 Kepler ..... E06B 1/70 49/468
6,371,188 B1 * 4/2002 Baczuk ..... E06B 1/70 160/92
6,789,358 B2 9/2004 Procton et al.
7,263,808 B2 * 9/2007 Massey ..... E05C 9/1808 52/204.1
7,266,929 B1 * 9/2007 Allred ..... E06B 1/70 49/467
7,389,611 B2 * 6/2008 Palenske CI ..... E06B 1/70 49/468
7,472,516 B2 * 1/2009 Pepper ..... E06B 1/70 49/467
8,132,370 B2 3/2012 Heppner
8,490,332 B2 * 7/2013 Van Camp ..... E06B 3/9632 49/468
8,991,100 B2 * 3/2015 Van Camp ..... E06B 1/70 49/469
9,051,777 B2 * 6/2015 Van Camp ..... E06B 1/70
9,097,043 B2 8/2015 Mitchell et al.
9,487,992 B2 * 11/2016 Meeks ..... E06B 1/70
10,202,795 B2 * 2/2019 Swank ..... E06B 1/70
10,612,291 B2 * 4/2020 Bryant ..... E06B 1/70
2002/0129557 A1 * 9/2002 Young ..... E06B 1/70 49/468
2004/0139667 A1 * 7/2004 Massey ..... E05C 9/1808 52/204.1
2006/0005470 A1 * 1/2006 Mullen ..... E06B 1/70 49/467
2006/0174545 A1 * 8/2006 Young ..... E06B 1/70 49/468
2006/0283090 A1 * 12/2006 Moody ..... E06B 1/70 49/467
2008/0120914 A1 * 5/2008 Fink ..... E06B 1/56 49/469
2008/0229669 A1 * 9/2008 Abdollahzadeh ..... E06B 1/70 49/468
2010/0205869 A1 * 8/2010 Pangburn ..... E06B 1/68 52/60
2015/0096235 A1 * 4/2015 Rochman ..... E06B 7/14 49/470
2016/0215555 A1 * 7/2016 Meeks ..... E06B 1/70
2017/0342764 A1 * 11/2017 Headrick ..... E06B 7/2316
2018/0100345 A1 * 4/2018 Meeks ..... E06B 7/14
2019/0338544 A1 * 11/2019 Kendall ..... E06B 1/70
2019/0352957 A1 * 11/2019 Kinville ..... E06B 1/70

* cited by examiner

DURABLE ENTRYWAY THRESHOLD

RELATED APPLICATIONS

This application claims priority to U.S. Provisional Application No. 62/824,025 filed on Mar. 26, 2019 and U.S. Provisional Application No. 62/908,771 filed on Oct. 1, 2019 both of which are incorporated herein by reference in their entirety.

TECHNICAL FIELD AND BACKGROUND

The present invention relates generally to entryway systems, and more particularly, to entryway threshold assemblies.

Conventional threshold assemblies are made of wood or metallic materials that are susceptible to damage from mechanical stress and ultraviolet light that degrades the overall appearance of the threshold and that may result in the removal of any paint or decorative coatings applied to the threshold exterior. Threshold assemblies are commonly damaged, for example, during construction as a result of heavy foot traffic and the transport of construction materials and waste into and out of a structure. Existing threshold also tend to be thermally conductive and, therefore, not energy efficient.

In addition to being durable, entryway threshold assemblies should be constructed to fit doors of varying heights and entryways of varying widths or lengths. With regard to spacing between the threshold and the bottom of a door, by maintaining a predetermined clearance between the threshold and the door, a door seal can effectively keep out unwanted intrusion of wind, moisture, pests, light, or thermal energy. It would further be advantageous to provide threshold assemblies constructed in a modular fashion that can be configured to fit entryways having varying door frame widths or entryway applications where it is desired to extend the length of the threshold outward from the entryway opening.

What is needed is a durable, aesthetically pleasing entryway threshold that is not only easy to install but also convenient to repair or replace when damaged. Preferably, the threshold assembly should also be adjustable to fit doors of varying heights and entryways of varying widths and lengths while providing a good thermal barrier to enhance energy efficiency in the associated building structure and to prevent condensation or icing that can reduce friction and lead to hazardous, slippery surfaces on or around an entryway.

It is, therefore, an object of the present invention to provide a threshold assembly that is durable and resistant to damage from mechanical stress and ultraviolet light exposure, adjustable to fit varying door heights and entryways of varying widths and lengths, thermally insulating, aesthetically pleasing, and convenient to repair all while providing the ability to manufacture the threshold in a cost effective manner.

SUMMARY

One embodiment of the threshold assembly includes a base portion having a rear nose wall, a vertically aligned attachment groove, a base channel extending between the rear nose wall and the attachment groove, and a top portion extending from a base portion front face to the attachment groove. The base channel accommodates a cap that optionally includes an adjustment screw that raises or lowers the cap or an associated screw cap cover to meet the bottom surface of doors of varying heights. The base top portion can be a graded surface with the height proximal to the attachment groove being a greater than the height near the front face to promote moisture runoff. The threshold assembly also includes a deck cover with a front surface, a rear face, a deck cover top surface extending between the front deck cover surface and the rear face, and a lower attachment wall extending downward from the deck cover top surface and configured to sit within the attachment groove to releasably secure the deck cover to the base portion. The assembly also includes a cap sized to sit within the base channel.

The base portion can also include a base channel wall that defines one sidewall of the attachment groove and an attachment groove shoulder that frictionally engages a lower attachment wall tab on the deck cover to further secure the deck cover to the base portion and help prevent moisture intrusion. The deck cover can also be secured to the base using a rabbeted front edge on the front face of the base that couples to a flange on the front deck cover surface.

The cap can also include additional features, such as a cap body having a cap interior cavity, a cap barrier portion extending from the front of cap body to define a cap recess that accommodates a vertically aligned dam portion of the deck cover, and cap legs that extend downward from the cap body and securely fit within the base channel. The cap can be made adjustable through a cap adjustment screw that extends through a passage in the cap body such that turning the screw raises or lowers the cap to meet doors of varying heights. The cap barrier portion optionally utilizes a cap gasket disposed on a distal end of the cap barrier opposite the cap body. The cap gasket frictionally engages the vertical dam portion and serves to further seal the cap recess and prevent moisture intrusion into the interior components of the threshold assembly and entryway.

Sizing notches can be formed in the base portion to make it easier to cut the threshold assembly to a given width to accommodate entryways of different widths. The base portion in some embodiments utilizes voids to save weight, transverse support ribs to add rigidity, or fastener blocks that accommodate fasteners driven into the base to secure the threshold assembly in place within an entryway. To extend the length of a threshold assembly, the deck cover can incorporate a deck cover nose extending from the front face that defines a nose cavity sized to couple to a projection on a threshold extender component.

In some embodiments, the deck cover or other components are made from a material that includes a coextruded first thermoplastic material and a coextruded polyvinyl chloride material. The first thermoplastic material can be an acrylic material, such as polymethyl methacrylate. The deck cover material can incorporate impact modifiers, such as nylon fibers or acrylate modifiers, among others, as well as other additives, such as ultraviolet light inhibiters and pigments. To reduce cost, the base portion or other components can be made from an injection-molded polyvinyl chloride composite material. The base portion can also be bonded to the deck cover, cap, and/or a nose cover made from separate coextruded thermoplastic materials.

BRIEF DESCRIPTION OF THE FIGURES

Features, aspects, and advantages of the present invention are better understood when the following detailed description of the invention is read with reference to the accompanying figures, in which.

DETAILED DESCRIPTION

Figure 1:
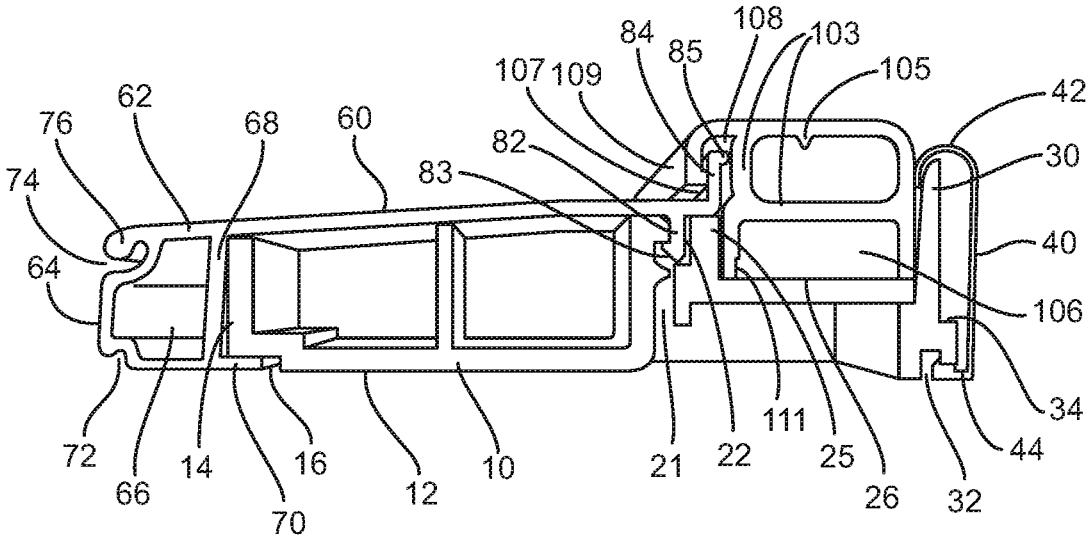
FIG. 1 is a cutaway, side view of a threshold assembly according to one embodiment.

The present invention will now be described more fully hereinafter with reference to the accompanying pictures in which exemplary embodiments of the invention are shown. However, the invention may be embodied in many different forms and should not be construed as limited to the representative embodiments set forth herein. The exemplary embodiments are provided so that this disclosure will be both thorough and complete and will fully convey the scope of the invention and enable one of ordinary skill in the art to make, use, and practice the invention.

Relative terms such as lower or bottom; upper or top; upward, outward, or downward; forward or backward; and vertical or horizontal may be used herein to describe one element's relationship to another element illustrated in the figures. It will be understood that relative terms are intended to encompass different orientations in addition to the orientation depicted in the drawings. By way of example, if a component in the drawings is turned over, elements described as being on the "bottom" of the other elements would then be oriented on "top" of the other elements. Relative terminology, such as "substantially" or "about," describe the specified materials, steps, parameters, or ranges as well as those that do not materially affect the basic and novel characteristics of the claimed inventions as whole (as would be appreciated by one of ordinary skill in the art).

Disclosed is a threshold assembly that includes a base 10, a nose cover 40, a deck cover 60, cap 100, and an adjustment screw 50. As described more fully below, the threshold assembly can be constructed so that the deck cover 60, nose cover 40, and cap 100 are all capable of being removed or installed without the need for tools, thereby making the threshold assembly easier for purposes of installation and/or repair.

Figure 2:
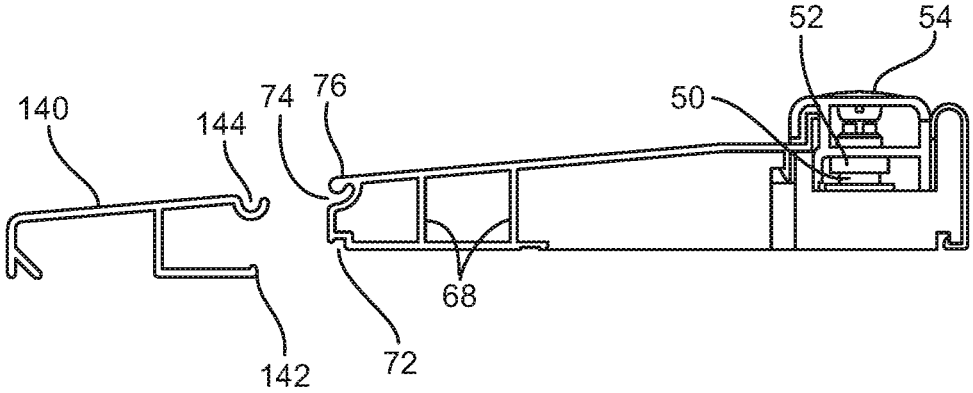
FIG. 2 is a cutaway, side view of a threshold assembly according to one embodiment.
Figure 3:
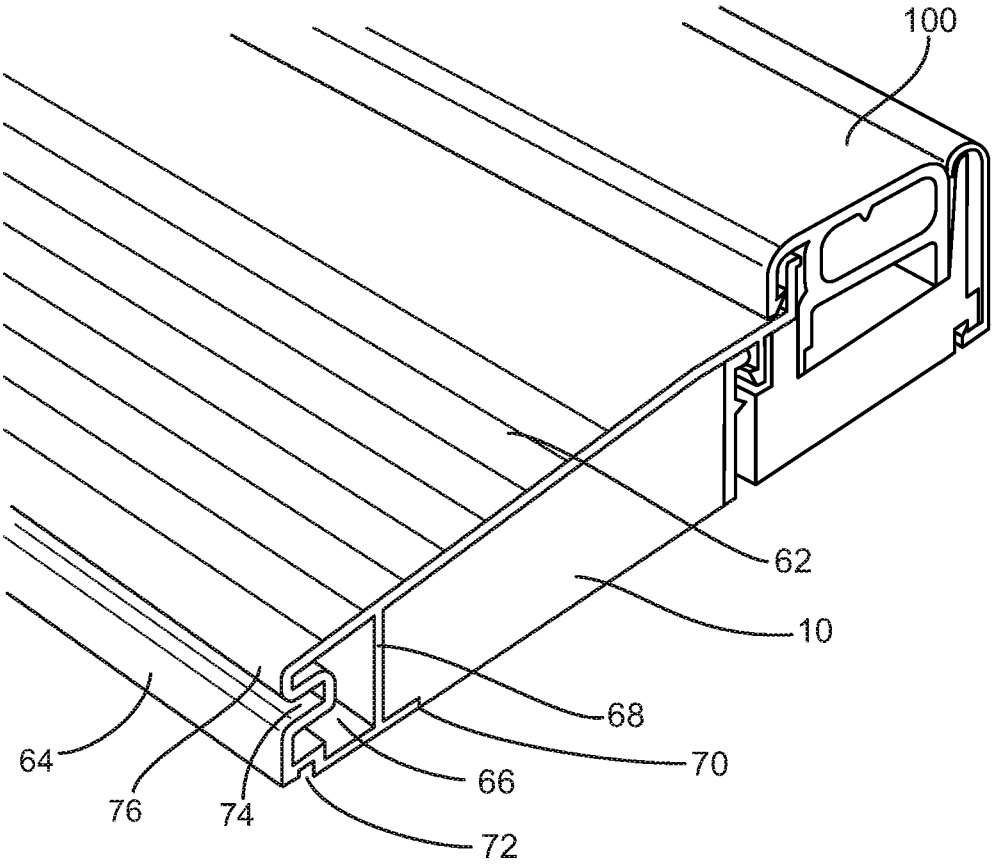
FIG. 3 is a perspective view of a threshold assembly according to one embodiment.
Figure 4:
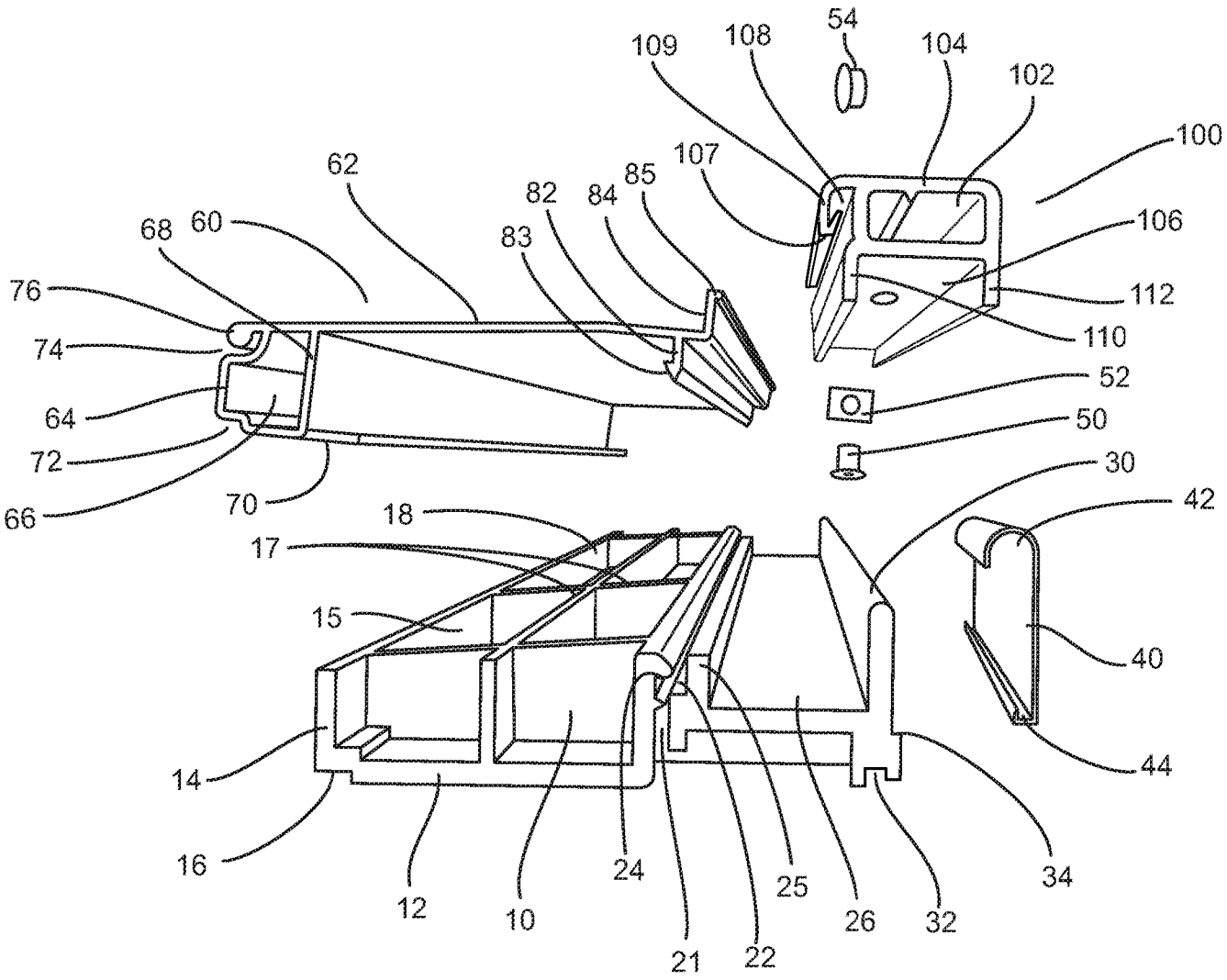
FIG. 4 is an exploded view of a threshold assembly according to one embodiment.
Figure 5:
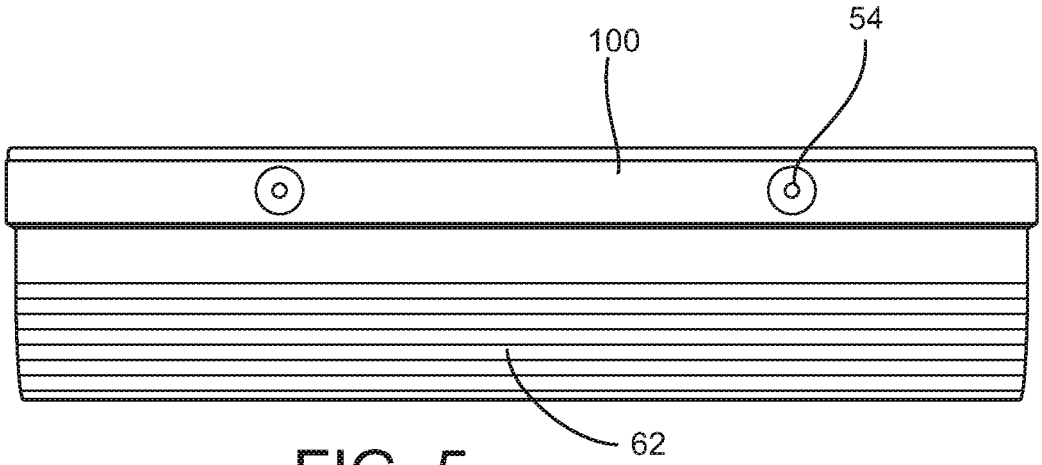
FIG. 5 is a top view of a threshold assembly according to one embodiment.
Figure 6:
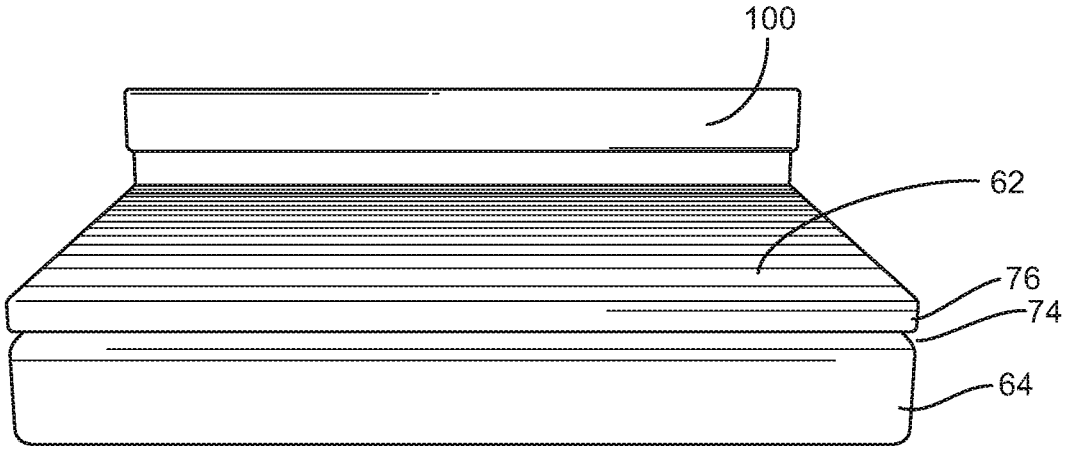
FIG. 6 is a front view of a threshold assembly according to one embodiment.

In addition to being convenient to install and repair, the modular construction also allows the threshold assembly to accommodate entryways of varying dimensions. To illustrate, the adjustment screw 50 allows the height of the cap 100 to be adjusted so as to create an appropriate seal between the threshold assembly and the bottom of a door. The base 10 can be constructed in a modular fashion such that it can be cut to various widths to accommodate entryways of varying widths within a door frame. The deck cover 60 can be constructed so as to accommodate a threshold extender 140, as shown in FIG. 2, that lengthens the threshold assembly as it extends from an entryway and that can be installed on the deck cover 60 without the need for special tools.

One or more of the deck cover 60, threshold extender 140, the nose cover 40, the cap 100, and base 10 can be made from thermoplastic materials that have superior mechanical, thermal, aesthetic, and other properties as compared to conventional threshold assemblies. As one example, the outside surfaces or "skin" of the deck cover 60, threshold extender 140, the nose cover 40, and/or the cap 100 are made from a polymethyl methacrylate ("PMMA") material. The PMMA material has the advantage of high tensile strength, scratch resistance, high ultraviolet (UV) light tolerance, chemical resistance, and PMMA can be processes using a variety of techniques, such as extrusion, injection molding, physical cutting, laser cutting, welding, among others.

The PMMA or other acrylic materials also have the advantage of good aesthetic qualities as it readily accepts pigments, is generally optically transparent, can be imprinted with designs, and is easy to clean owing to low surface tension that does not permit materials to stick to its surface. Thermoplastic materials can be formed with particular colors or patterns that extend through the entire material as opposed to a painted color coating. In this manner, the threshold maintains color in the face of not only potential damage from sunlight but also from mechanical damage (e.g., scratches, cracks, etc.) that might otherwise remove a color coating leading to a degradation in the aesthetic qualities of the threshold.

The heat resistance, chemical resistance, and impact resistance of PMMA, which is generally a brittle material, is enhanced using one or more impact modifiers where the impact modifiers can be, but are not limited to, acrylate monomers or acrylate polymers present in a range from 10% to 50% and preferably from 35% to 45%. The impact modifier can be comprised of, for instance, methyl methacrylate, methyl methacrylate-butadiene-styrene ("MBS"), polybutyl acrylate ("PBA"), or various polyacrylate polymers. In one embodiment, the components of the threshold assembly are formed using a thermoplastic material that is reinforced with nylon fibers, which can serve as an impact modifier and which are suited for use in an extrusion process, to provide enhanced mechanical performance, durability, and thermal resistance. One or more of these components can also be formed using a polyvinyl chloride ("PVC") material either alone or with PMMA and impact modifiers.

In one embodiment, the outer skin of the deck cover 60, the nose cover 40, the cap, 100, and/or threshold extender 140 are formed using a coextrusion process that relies on dual durometers to form an extradate composed of more than one thermoplastic melt stream, such as a thermoplastic base material (e.g., a PMMA based material with acrylate impact modifiers) melt stream and a PVC melt stream. The advantages of utilizing an extrusion process to form the outer surfaces as opposed to other processes, such as injection molding, include the ability to create laminar structures that are less porous with increased density, impact resistance, and resistance to shattering.

Those of skill in the art will appreciate that various types of thermoplastics can be used to form the components of the threshold assemblies disclosed herein, including, but not limited to, various acrylic monomers or polymers, acrylonitrile butadiene styrene ("ABS"), polylactide, polybenzimidazole ("PBI"), polycarbonate, polyether sulfone ("PES"), polyoxymethylene ("POM"), polyether ether ketone ("PEEK"), polyetherimide ("PEI"), polyethylene, polyphenylene oxide ("PPO"), polyphenylene sulfide ("PPS"), polypropylene, polystyrene, polyvinyl chloride ("PVC"), polyvinylidene fluoride, and Teflon.

In one exemplary embodiment, the base 10, nose wall 30, nose cover 40, cap 100, threshold extender 140, or one or more of the other components are formed from a PVC composite material that includes (1) PVC; (2) calcium; (3) grindering material; (4) wood flour; (5) acrylic processing aid; (6) 118A stabilizer; (7) stabilizer; (8) AC foaming agent; (9) white foaming agent; (10) 629 polyethylene wax; (11) polyethylene wax; and (12) 1801 stearic acid. Those of skill in the art will appreciate that the above composition can be varied to some degree while still achieving the benefits described herein.

In yet other embodiments, a PVC composite material can be used to form the bulk of the various components using injection molding or extrusion while the outer surface or skin of the components is formed using a combination of coextruded PMMA with impact modifiers and coextruded PVC. In this manner, the bulk portion of the components can be made from a lighter, cheaper material while the outer surfaces are made from more scratch resistant, shatter resistant, UV resistance, heat resistant, chemically resistant, and aesthetically advantageous material.

The use of injection molding to form various components has the advantage of permitting the formation of threshold components with more complex geometries. This in turn permits components to be formed with features that permit tool-free, snap fit assembly or features that save weight, such as cavities or cutouts, as illustrated in the attached figures and discussed below. The PVC composite materials can also be subjected to extrusion to form various components of the threshold assemblies, such as the unitary base components that are also shown in the attached figures, including FIGS. 12-13.

The enhanced properties of the acrylic or other thermoplastic materials are achieved while still reducing the cost of threshold manufacturing over conventional threshold materials. Conventional threshold materials, such as aluminum are costly and subject to sudden and wide price fluctuations, supply chain availability constraints in both the United States and overseas due to varying tariffs or regulatory barriers, and require additional costly processing steps during manufacturing, such as anodization. Thermoplastic materials have the advantage of avoiding such cost and supply chain constraints, and are less expensive and easier to process as they do not require anodization, and the cost of extruding or injection molding the materials to the desired form is significantly less than the cost of extruding aluminum. The acrylic and other thermoplastic materials used to form the thresholds disclosed herein are more durable, dent resistant, and lighter weight than existing threshold materials. The materials are also chemically resistant to a wide range of substances such that they are not subject to corrosion from paints, finishes, cleaners, various other construction or household materials. Thermoplastics in particular also have the advantages of being recyclable and capable of being remolded.

In some embodiments, the threshold components incorporate an UV light inhibitor that enhances resistance to damage and color fading from sunlight for up to ten years. The UV light inhibitor is provided as an additive to the thermoplastic materials. The composition of the UV light inhibitor can vary depending on the properties and composition of the thermoplastic materials used to form the threshold components as well as the particular cost concerns, among other factors. Suitable UV light inhibitors can include, for instance, combinations of carbon black, rutile titanium oxide, hydroxybenzophenone, hydroxyphenylbenzotriazole, oxanilides for polyamides, benzophenones for PVC materials, and benzotriazoles and hydroxyphenyltriazines for polycarbonate materials, or Hindered Amine Light Stabilizers ("HALS"), among other compounds known to those of skill in the art.

The improved thermal properties of the thermoplastic materials can create a thermal break that improves energy efficiency within the associated building structure. The thermoplastic materials have the additional advantage that they do not facilitate condensation as in conventional metallic thresholds, which can create a safety hazard as moisture collects on a threshold surface, thereby reducing friction and making the threshold slippery.

Turning the attached figures, one exemplary embodiment shown in FIGS. 1 to 11 utilizes a base portion 10 that includes a bottom surface 12, a front face 14 having a rabbeted front edge 16, a top surface 18 having longitudinal and transverse support ribs 17 and a plurality of voids 15, a sizing notch 19 adjacent to a fastener block 23, a slit 21, an attachment groove 22 having an attachment groove shoulder 24, a base channel wall 25, a channel 26, a nose wall 30, a nose groove 32, and a nose wall recessed portion 34. The top surface 18 is graded to facilitate the runoff of moisture from the threshold as well as to provide a smooth transition from the threshold to the surrounding ground area. The base channel 26 is sized to accommodate the cap 100.

In some embodiments, the base 10 can be formed from plastic materials using injection molding techniques. Use of injection molding techniques has the advantage of relatively low cost and flexibility in the formation of various features of the base 10, such as the voids 15, support ribs 17, sizing notch 19, and slits 21, among other features. Formation of the voids 15, slits 21, and the nose wall recessed portion 34 conserves materials during manufacturing and results in reduced weight during shipping to provide significant cost savings. The transverse and longitudinal support ribs 17 extend between the voids 15 to provide mechanical rigidity to support a deck cover 60 installed on the base 10.

Figure 7:
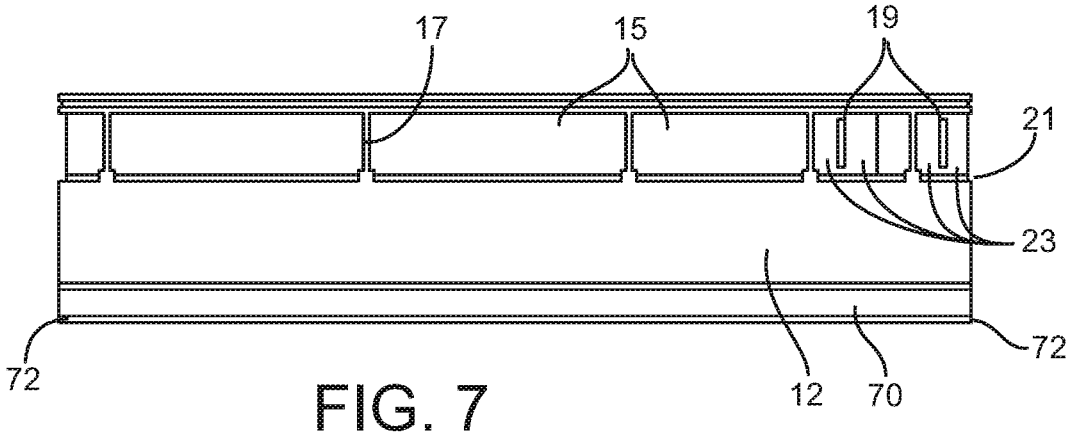
FIG. 7 is a bottom view of a threshold assembly according to one embodiment.
Figure 8:
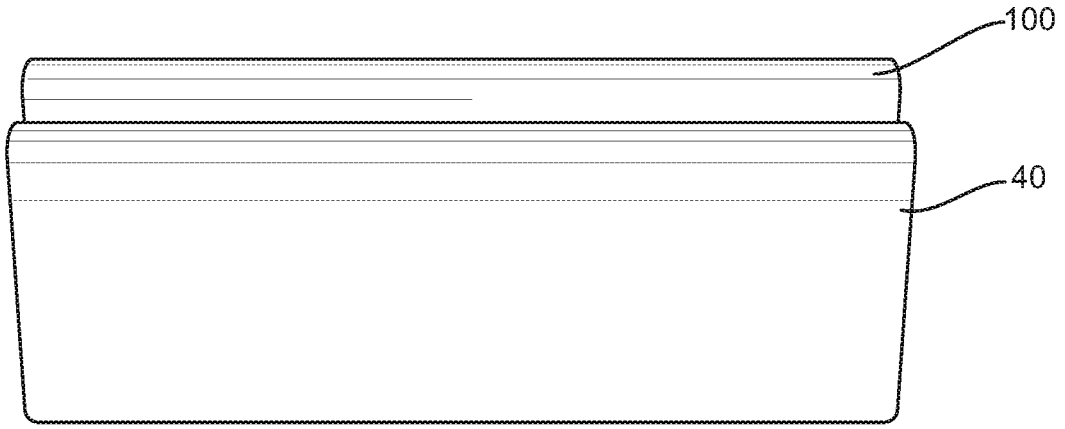
FIG. 8 is a rear view of a threshold assembly according to one embodiment.
Figure 9:
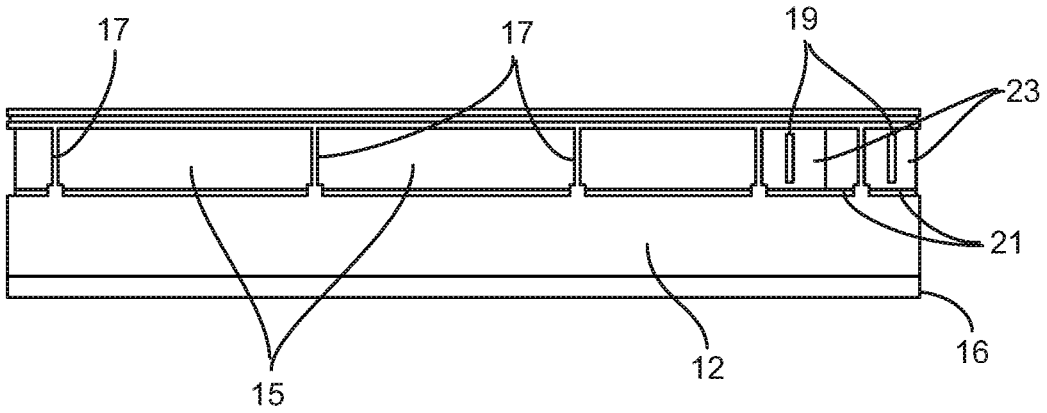
FIG. 9 is a bottom view of a base according to one embodiment.
Figure 10:
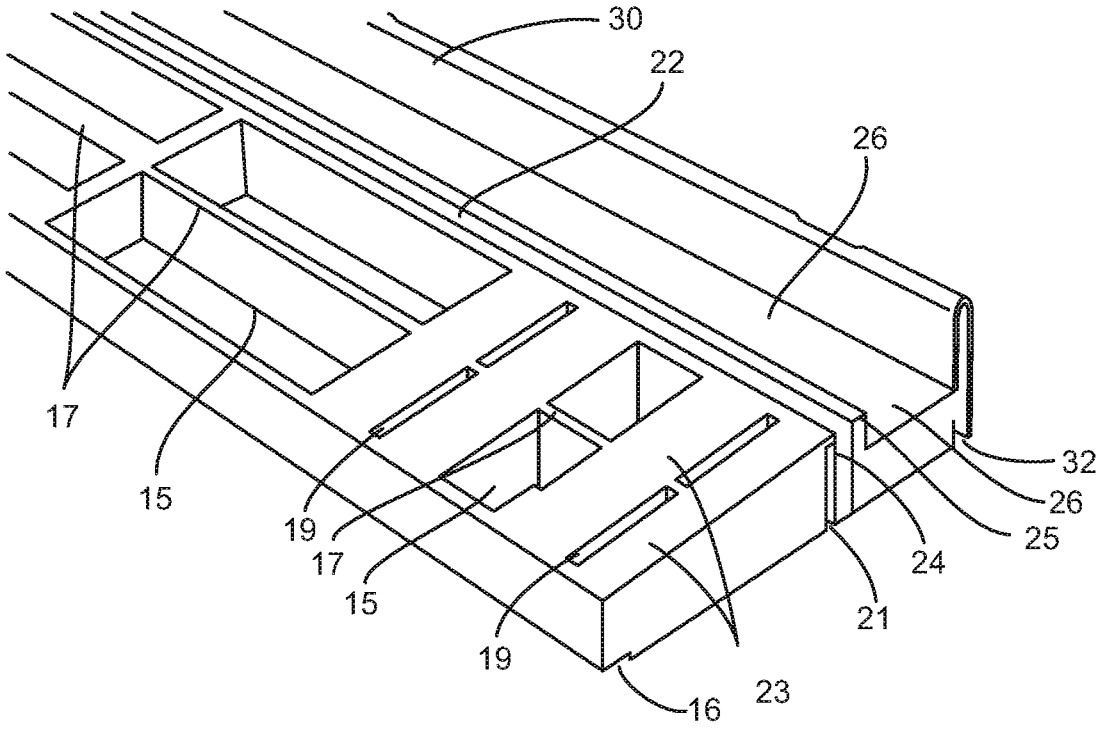
FIG. 10 is a perspective view of a base according to one embodiment.
Figure 11B:
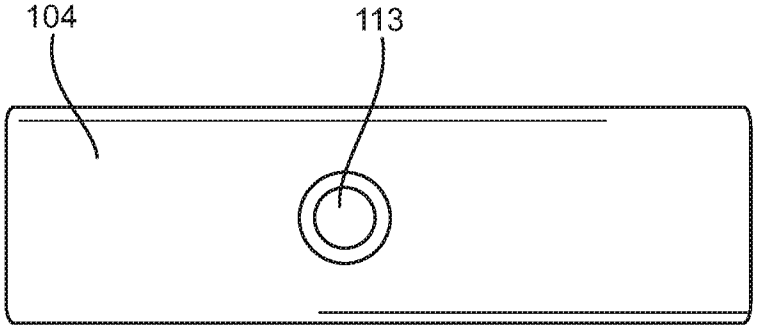
FIG. 11B is a top view of a cap according to one embodiment.
Figure 11A:
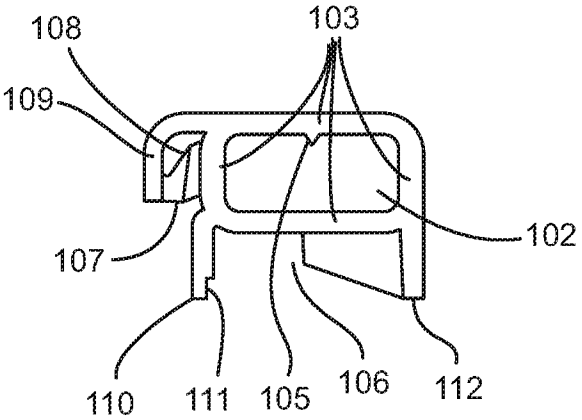
FIG. 11A is a side view of a cap according to one embodiment.
Figure 11C:
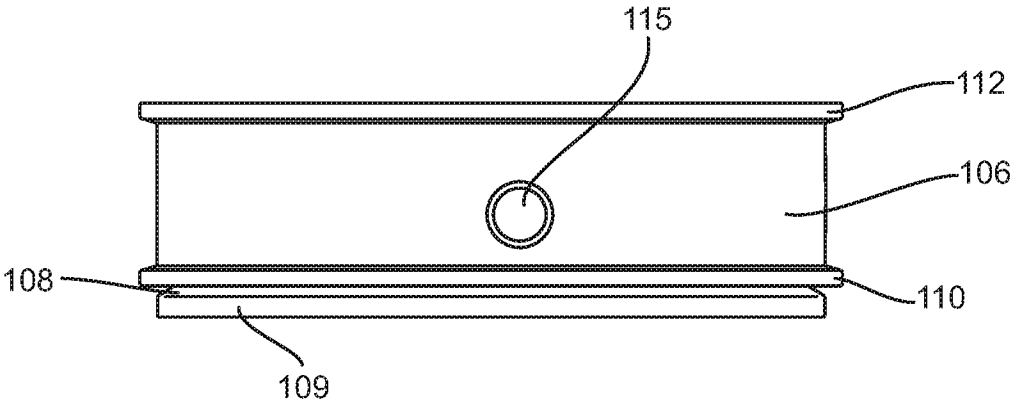
FIG. 11C is a bottom view of a cap according to one embodiment.

As shown more particularly in FIG. 7, the base 10 can be sized to accommodate threshold entryways of different widths by cutting the base 10 along one of the sizing notches 19 adjacent to one of the fastener blocks 23 to ensure there is some solid portion of the base 10 through which a fastener can be driven (i.e., the fastener block 23) to secure the threshold assembly within a door frame.

The deck cover 60 is secured to the base 10 through the rabbeted front edge 16 that is sized to accommodate a bottom flange 70 of the deck cover 60 and through the attachment groove 22 and groove shoulder 24 that are sized to accommodate a deck cover lower attachment wall 82 and lower attachment tab 83. In this manner, the deck cover 60 can quickly and conveniently be removed and replaced prior to installation in a door frame by securing the bottom flange 70 of a new deck cover 60 about the rabbeted front edge 16 and snap fitting the lower attachment tab 83 into the attachment groove 22 so that it frictionally engages the groove shoulder 24. The deck cover 60 rear wall includes a dam portion 84 and a dam portion tab 85 that is sized to fit within the cap portion channel 108 to prevent moisture intrusion within the threshold assembly and to secure the deck cover 60 to the cap 100. The use of thermoplastic materials and the secure fit provided by the snap-fit assembly construction of the disclosed threshold assemblies eliminates or substantially reduces "deck chatter," which are the cracking noises emanating from conventional threshold assemblies in response to an applied load when the materials used to construct the threshold are loosely fit together, brittle, or otherwise susceptible to mechanical movement and deflection producing unwanted noise.

A nose cover 40 can be secured about the nose wall 30 to protect the nose wall 30 against wear and tear. The nose cover 40 includes an arcuate attachment portion 42 that fits over the top of the nose wall 30 as well as a nose attachment tab 44 that fits within the nose groove 32 to secure the nose cover 40 in place over the nose wall 30.

The deck cover 60 includes an upper tread surface 62 as a safety feature to militate against slipping of individuals and objects passing over the threshold. The deck cover 60 further includes a front deck cover face 64, an interior channel 66, a deck cover support wall 68, a bottom flange 70, a deck cover rabbeted portion 72, and a deck cover nose 76 and nose cavity 74. Formation of the deck cover 60 with an interior channel 66 saves material and weight during manufacturing and shipping, thereby making the deck cover 60 less expensive to manufacture and lighter weight for shipping and use. The deck cover support wall 68 adds rigidity and strength to the front portion of the deck cover 60.

The deck cover nose 76 is rounded to help facilitate objects passing over the edge of the threshold onto the deck cover tread surface 62. As force is applied to the deck cover nose 76 from a passing object or individual, the nose 76 deflects into the nose cavity 74, which allows the deck cover nose 76 to bear additional loads without buckling or experiencing mechanical failure. The deck cover 60 is configured to accommodate a threshold extender 140, as shown in FIG. 2, where the deck cover rabbeted portion 72 receives an extender tab 142, and the nose cavity 74 receives an extender attachment projection 144.

The threshold assembly cap 100 includes a cap body 103 defined by one or more sidewalls, a cap barrier portion 109, a cap gasket 107 affixed to the inside of the barrier portion 109, a cap interior cavity 102, a cap top surface 104, a top surface support ridge 105 to add strength and rigidity, a cap first leg 110, a cap first leg rabbeted edge 111, and a cap second leg 112 where both the cap first leg 110 and the cap second leg 112 define a cap recess 106.

The cap barrier portion 109 defines a cap channel 108 that accommodates the dam portion 84 and dam portion tab 85. When the dam portion 84 is seated within the cap channel 108, the cap gasket 107 frictionally engages the dam portion 84 and serves to prevent moisture, particulate, or other contaminants from entering the threshold components. The cap first leg 110 and the cap second leg 112 are secured within the base channel 26 by frictionally engaging the deck cover channel wall 25 and the nose cover attachment portion 42. Forming the cap with an interior cavity 102 and recess 106 saves material during manufacturing leading to a lower cost, lighter weight assembly.

The interior cavity 102 and recess 106 additionally serve to accommodate the adjustment screw 50 and washer 52 that can be used to vary the height of the cap 100. The cap adjustment screw 50 is protected from mechanical damage and moisture intrusion by a cap screw cover 54. The cap screw cover 54 is housed within a cap first passage 113 formed in the cap top surface 105 and that extends through to the cap interior cavity 102. The cap adjustment screw 50 is housed within a cap second passage 115 formed in a surface of the cap recess 106 and that also extends through to the cap interior cavity 102. In the overall door assembly, the cap top surface 104 frictionally engages the lower portion of the associated door or door sweep (not shown). By turning the adjustment screw 50, the cap 100 and/or the cap screw cover 54 can be raised or lowered to ensure a proper fit between the threshold assembly and the door components.

The components of the threshold embodiment disclosed herein can be formed using any suitable means known to one of ordinary skill in the art, such as injection molding, extrusion, three-dimensional printing, or the like. Moreover, one or more of the parts components can be formed integrally with another component, or alternatively, split into a multitude of other separate components. For instance, the front portion of the deck cover 60 can be formed as a separate extender portion similar to the embodiment depicted in FIG. 2 while remaining deck cover 60 components are formed as a separate component. Alternatively, as shown in FIGS. 12 and 13, the deck cover 60 can be formed integrally with the base portion 10, or the base portion nose wall 30 can be formed integrally with the nose cap 40.

Figure 12:
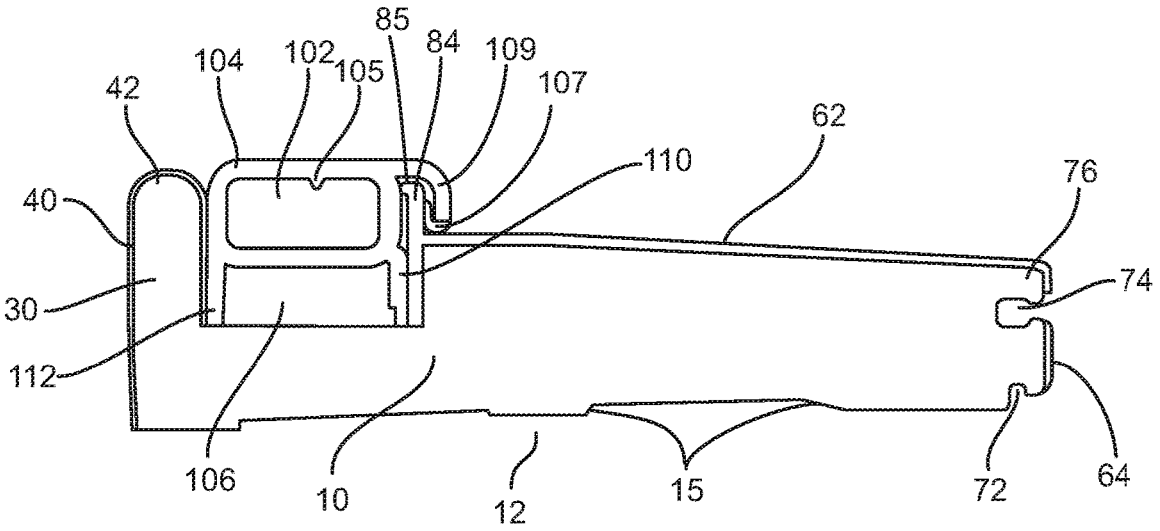
FIG. 12 is a side view of a threshold assembly according to one embodiment.
Figure 13:
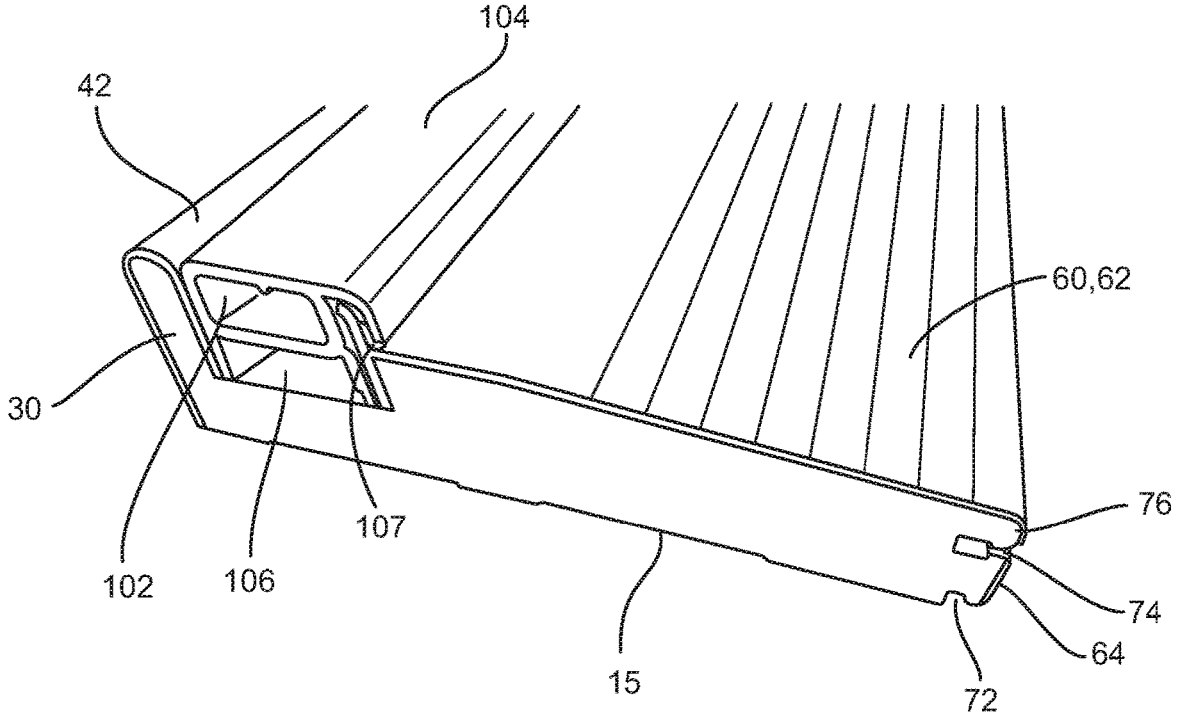
FIG. 13 is a perspective view of a threshold assembly according to one embodiment.

In one embodiment, depicted in FIGS. 12 and 13, the base 10 is formed from a PVC composite material utilizing an extrusion process. The deck cover 60 is formed using a coextrusion process with two separate melt streams: (1) a first melt stream having a thermoplastic material, such as PMMA, with one or more impact modifiers, pigments; and (2) a second PVC melt stream. The thermoplastic and PVC melt streams may optionally include a pigment, UV inhibitor, or other additives to enhance material performance or aesthetic qualities. The two extruded melt streams form a single layer deck cover 60 that is bonded or laminated on the base 10 such that the base 10 and deck cover 60 form a unitary component.

A third extrusion melt stream of PVC material having a pigment additive is utilized to form the nose cover 40 that is also laminated or bonded to the nose wall 30 of the base to form a unitary component. The deck cover 60 and nose cover 40 can be secured or bonded to the base 10 using any suitable technique known to one of skill in the art, including, for example, lamination using heat, pressure, or adhesives to bond the components together. The cap 100 is formed from a PVC or PVC composite material using either injection molding or extrusion.

The unitary base 10, deck cover 60, and nose cover 40 structure has the benefits of reduced assembly time at an installation site, a reduction in the number of parts that may separate or loosen over time, and the elimination or substantial reduction of deck chatter, among other advantages. For instance, because the deck cover 60 shown in FIGS. 12 and 13 is secured to the base 10, the need for the attachment groove shoulder 24 and attachment groove 22 is eliminated. Even with the unitary construction, however, the coextrusion processes permit the formation of weight saving features, such as the base voids 15, and the formation of useful features, such as the moisture barrier dam portion 84 and dam portion tab 85 and the nose 76 and nose cavity 74.

Figure 14:
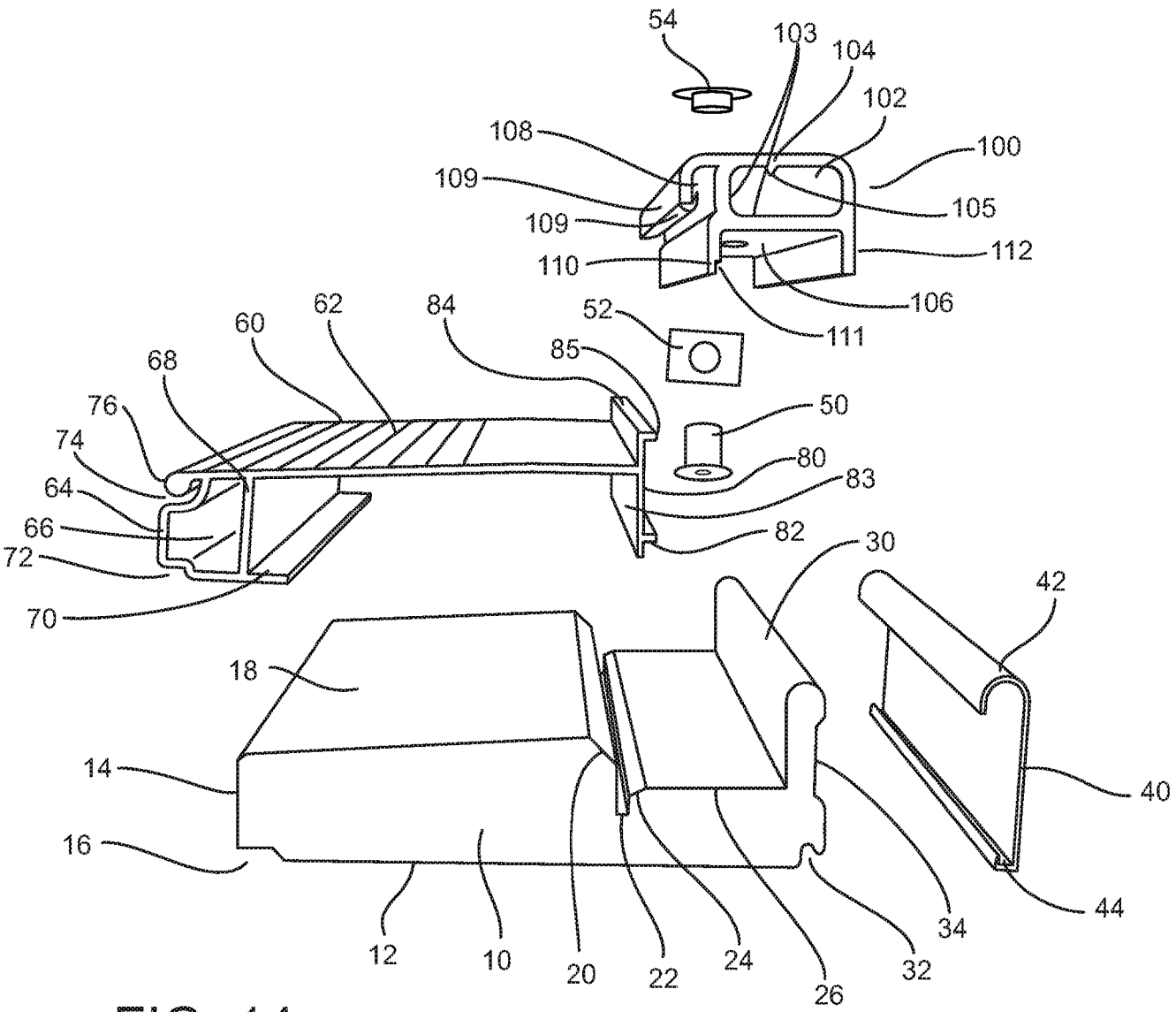
FIG. 14 is an exploded view of a threshold assembly according to one embodiment.

In yet another embodiment shown in FIG. 14, the threshold assembly utilizes a combination of a solid block unitary PVC base 10 with a separable deck cover 60 and nose cover 40. The base rabbeted front edge 16 is sized to accommodate the bottom flange 70 of the deck cover 60, and the attachment groove 22 and groove shoulder 24 are sized to accommodate a deck cover lower attachment wall 82 and lower attachment tab 83 to secure the deck cover 60 to the block base 10. The base channel 26 is sized to accommodate the cap 100 consistent with the other disclosed embodiments. The base 10 further includes a beveled portion 20 to better accommodate installation of the deck cover 60 and deflection of the deck cover 60 when subjected to a load.

Although the foregoing description provides embodiments of the invention by way of example, it is envisioned that other embodiments may perform similar functions and/or achieve similar results. Any and all such equivalent embodiments and examples are within the scope of the present invention.

What is claimed:

1. A threshold assembly comprising:
(a) a base portion having
(i) a rear face comprising a nose wall,
(ii) a base channel extending between the nose wall and a base channel wall,
(iii) a front face,
(iv) a top portion extending from the front face to an attachment groove shoulder, wherein the attachment groove shoulder comprises a beveled upper surface, and
(v) an attachment groove between the attachment groove shoulder and the base channel wall;
(b) a deck cover made from a single thermoplastic material layer comprising a first thermoplastic material coextruded with a polyvinyl chloride material, wherein the deck cover comprises
(i) a front deck cover surface,
(ii) a rear side,
(iii) a deck cover top surface extending between the front deck cover surface and the rear side, and
(iv) a lower attachment wall extending from the deck cover top surface to a lower attachment tab having a beveled side surface, wherein the lower attachment wall is configured to seat within the attachment groove such that the lower attachment tab frictionally engages the attachment groove shoulder; and
(c) a cap sized to sit within the base channel.

2. The threshold assembly of claim 1, wherein the first thermoplastic material is an acrylic material with at least one impact modifier.

3. The threshold assembly of claim 1, wherein the first thermoplastic material is polymethyl methacrylate with at least one impact modifier.

4. The threshold assembly of claim 1, wherein the first thermoplastic material further comprises an ultraviolet light inhibitor.

5. The threshold assembly of claim 1, wherein the first thermoplastic material further comprises nylon fibers.

6. The threshold assembly of claim 1, wherein:
(a) the base portion front face further comprises a rabbeted front edge; and
(b) the front deck cover surface further comprises a flange configured to couple with the rabbeted front edge.

7. The threshold assembly of claim 1, wherein:
(a) the deck cover rear side comprises a vertically extending dam portion; and
(b) the cap comprises
(i) a cap body having a cap interior cavity,
(ii) a cap barrier portion extending from the cap body to define a cap channel, wherein the cap channel is sized to accommodate the dam portion,
(iii) a cap first leg and a cap second leg extending from the cap body, wherein the cap first leg and the cap second leg are spaced a distance apart such that when the cap is seated within the base channel, the cap first leg is proximal to the base channel wall, and the cap second leg is proximal to the nose wall,
(iv) a cap passage extending through the cap body into the cap interior cavity, and
(v) an adjustment screw disposed within the cap passage.

8. The threshold assembly of claim 7, wherein the cap barrier portion further comprises a cap gasket disposed on a distal end of the cap barrier portion opposite the cap body.

9. The threshold assembly of claim 1, wherein the base portion further comprises:
(a) a first axis extending along a direction between the front face and the rear face; and
(b) a sizing notch extending along the first axis.

10. The threshold assembly of claim 9, wherein the base portion further comprises a fastener block that defines a sidewall of the sizing notch.

11. The threshold assembly of claim 1, wherein:
(a) the deck cover further comprises a deck cover nose extending from the front face such that the deck cover nose defines a nose cavity between the deck cover nose and the front face; and
(b) the threshold assembly further comprises a threshold extender having an extender attachment projection configured to couple to the nose cavity.

12. The threshold assembly of claim 1, wherein:
(a) the base portion is made from an injection-molded polyvinyl chloride composite material; and
(b) the deck cover is bonded to the base portion.

13. The threshold assembly of claim 1, wherein the first thermoplastic material is polymethyl methacrylate with at least one acrylate impact modifier and a pigment.

14. The threshold assembly of claim 13, wherein the first thermoplastic material further comprising nylon fibers.

15. A threshold assembly comprising:
(a) a base portion having
(i) a rear face comprising a nose wall,
(ii) a base channel extending between the nose wall and a base channel wall,
(iii) a front face having a rabbeted front edge,
(iv) a top portion extending from the front face to an attachment groove shoulder,
(v) an attachment groove between the attachment groove shoulder and the base channel wall, and
(vi) a sizing notch extending in a direction between the front face and the rear face;
(b) a deck cover comprising a thermoplastic material layer formed by coextrusion of a single extrudate, wherein the single extrudate is formed from a first thermoplastic material melt stream and a polyvinyl chloride material melt stream, and wherein the deck cover comprises
(i) a front deck cover surface having a flange configured to couple with the base portion rabbeted front edge, (ii) a rear side having a vertically extending dam portion, (iii) a deck cover top surface extending between the front deck cover surface and the dam portion, (iv) a lower attachment wall extending from the deck cover top surface to a lower attachment tab, wherein the lower attachment wall is configured to seat within the attachment groove such that the lower attachment tab frictionally engages the attachment groove shoulder; and (c) a cap sized to seat within the base channel wherein the cap comprises (i) a cap body having a cap interior cavity, (ii) a cap barrier portion extending from the cap body to define a cap channel, wherein the cap channel is sized to accommodate the dam portion, (iii) a cap passage extending through the cap body into the cap interior cavity, and (iv) an adjustment screw disposed within the cap passage.

16. The threshold assembly of claim 15 wherein the first thermoplastic material comprises an acrylic material having at least one impact modifier.

17. The threshold assembly of claim 16 wherein:

(a) the base portion is made from an injection-molded polyvinyl chloride composite material; and (b) the deck cover is bonded to the base portion.

18. A threshold assembly comprising:

(a) a base portion having (i) a rear nose wall, (ii) a base channel extending from the rear nose wall, and (iii) a top portion extending from the base channel to a base portion front face;

(b) a deck cover formed as a single thermoplastic layer secured to the base portion, wherein the single thermoplastic layer is formed by coextrusion of a first thermoplastic material with a polyvinyl chloride material, wherein the deck cover comprises (i) a front deck cover surface, (ii) a rear side defining a moisture dam extending from a deck cover top surface; and (iii) the deck cover top surface extending between the front deck cover surface and the rear side, and (c) a cap sized to sit within the base channel.

19. The threshold assembly of claim 18 further comprising a rear nose wall cover formed as a layer secured to the base portion, wherein the rear nose wall cover is made from a material comprising an extruded polyvinyl chloride.

20. The threshold assembly of claim 18, wherein the base portion is made from a material comprising an extruded polyvinyl chloride composite material and the deck cover is secured to the base portion by bonding the deck cover to the base portion to form a unitary component.

21. The threshold assembly of claim 18, wherein the first thermoplastic material further comprises nylon fibers and an ultraviolet light inhibitor.

22. The threshold assembly of claim 18, wherein the cap comprises:

(a) a cap body having a cap interior cavity, (b) a cap barrier portion extending from the cap body to define a cap channel, wherein the cap channel is sized to accommodate the moisture dam, (c) a cap passage extending through the cap body into the cap interior cavity, and (d) an adjustment screw disposed within the cap passage.

23. The threshold assembly of claim 18, wherein the first thermoplastic material further comprises an impact modifier.

24. The threshold assembly of claim 18, wherein the deck cover is secured to the base portion by bonding the deck cover to the base portion to form a unitary component.

* * * * *